US012037754B2

(12) United States Patent
Suzuki et al.

(10) Patent No.: US 12,037,754 B2
(45) Date of Patent: Jul. 16, 2024

(54) BREATHER FOR VIBRATION GENERATING DEVICE

(71) Applicant: MIKASA SANGYO CO., LTD., Tokyo (JP)

(72) Inventors: Sadahisa Suzuki, Saitama (JP); Kouta Sasaki, Saitama (JP); Tomoya Warashina, Saitama (JP)

(73) Assignee: MIKASA SANGYO CO., LTD., Tokyo (JP)

( * ) Notice: Subject to any disclaimer, the term of this patent is extended or adjusted under 35 U.S.C. 154(b) by 0 days.

(21) Appl. No.: 17/790,456

(22) PCT Filed: May 26, 2021

(86) PCT No.: PCT/JP2021/020015
§ 371 (c)(1),
(2) Date: Jun. 30, 2022

(87) PCT Pub. No.: WO2022/249341
PCT Pub. Date: Dec. 1, 2022

(65) Prior Publication Data

US 2024/0141600 A1 May 2, 2024

(51) Int. Cl.
*E01C 19/38* (2006.01)
*F01M 13/00* (2006.01)

(52) U.S. Cl.
CPC ..... *E01C 19/38* (2013.01); *F01M 13/0011* (2013.01)

(58) Field of Classification Search
CPC . F16C 3/20; F16C 1/108; F16C 9/527; F01M 13/0011; E01C 19/286; E01C 19/38; F16N 7/26
(Continued)

(56) References Cited

U.S. PATENT DOCUMENTS 3,970,292 A * 7/1976 Dachicourt ..... B60G 15/12 188/315
6,227,760 B1 * 5/2001 Togami ..... E01C 19/38 74/61
(Continued)

FOREIGN PATENT DOCUMENTS

CN 203765030 U * 8/2014
CN 208749798 U * 4/2019
(Continued)

OTHER PUBLICATIONS

International Search Report (ISR) and Written Opinion dated Aug. 10, 2021, issued in International Application No. PCT/JP2021/020015.

*Primary Examiner* — George C Jin
*Assistant Examiner* — Teuta B Holbrook
(74) *Attorney, Agent, or Firm* — Holtz, Holtz & Volek PC

(57) ABSTRACT

A breather for a vibration generating device includes a center passage extending from an inner portion to an outer portion of a vibration generating shaft, an inner opening portion in an outer circumferential surface of the inner portion, an intake opening portion in a surface of the outer portion, an exhaust opening portion, an inner passage causing the center passage and the inner opening portion to communicate with each other, an intake passage causing the center passage and the intake opening portion to communicate with each other, and an exhaust passage causing the center passage and the exhaust opening portion to communicate with each other, an intake valve that opens in a case in which a pressure in the casing becomes negative disposed inside the intake passage, and an exhaust valve that opens in a case in which a pressure in the casing becomes positive disposed inside the exhaust passage.

9 Claims, 2 Drawing Sheets

(58) Field of Classification Search
USPC ..... 404/117, 122, 133.05; 123/198 R, 198 E
See application file for complete search history.

(56) References Cited

U.S. PATENT DOCUMENTS

| | | | | |
|---|---|---|---|---|
| 2006/0104718 | A1 | 5/2006 | Paske | |
| 2013/0167792 | A1* | 7/2013 | Evans | F02B 75/065 123/192.2 |
| 2014/0161529 | A1* | 6/2014 | Darscheid | E01C 19/38 404/117 |

FOREIGN PATENT DOCUMENTS

| | | | | |
|---|---|---|---|---|
| JP | S5613369 | Y2 | | 3/1981 |
| JP | S64638 | A | | 1/1989 |
| JP | H0660607 | U | | 8/1994 |
| JP | H11323817 | A | * | 11/1999 |
| JP | 2014001558 | A | | 1/2014 |

* cited by examiner

BREATHER FOR VIBRATION GENERATING DEVICE

TECHNICAL FIELD

The present invention relates to a breather for a vibration generating device mounted in a vibrating compaction machine.

BACKGROUND ART

Among vibrating compaction machines used for compacting a ground or the like, a model thereof provided with a compacting plate (such as a plate compactor or a vibro-compactor, for example) is configured such that a vibration generating device is disposed over the compacting plate and vibration generated by the vibration generating device is transmitted to the compacting plate to enable vibrating compaction of the ground or the like below the compacting plate.

A typical vibration generating device in a prior art includes a casing, an eccentric weight disposed inside the casing, a rotation shaft (vibration generating shaft) to which the eccentric weight is attached or which is integrated with the eccentric weight, and bearings supporting the vibration generating shaft. The vibration generating shaft is configured of a part extending inside the casing and a part (outer portion) penetrating through the casing and projecting outward, and is configured such that a rotational drive force is transmitted from a motor (an internal combustion engine, an electric motor, or the like) to the vibration generating shaft via a power transmission mechanism (such as pulleys secured to an output shaft of the motor and the outer portion of the vibration generating shaft respectively, and a V belt wound around the pulleys, for example) and the eccentric weight rotates inside the casing, thereby generating vibration.

Oil for lubricating the bearings and the like is stored in the casing. Also, the vibration generating shaft penetrating through the casing is sealed by oil seal, such that leakage (leakage to the outside of the casing along a circumferential surface of the vibration generating shaft) of the lubricant oil can be prevented.

Also, an air passage that causes an internal space and an external space of the casing to communicate with each other is typically formed in the vibration generating device. Although there is a possibility that, if the casing is tightly closed, the oil seal for sealing the vibration generating shaft may be damaged or may be detached from an appropriate attachment position when a difference in pressure occurs between the inside and the outside, it is possible to avoid such problems by forming the air passage that causes the inside and the outside of the casing to communicate with each other. Note that the air passage that causes the inside and the outside of the casing to communicate with each other and allows air to flow in and out is typically called a "breather".

In a case in which a breather is formed in the vibration generating device to cause the inside and the outside of the casing to communicate with each other, there is a possibility that dust generated in a compacting operation and the like may invade the internal space of the casing from the breather, and in this case, there is a concern that bearings and other movable parts may be damaged. Therefore, it is considered to be effective to form an outer opening portion of the breather at a position which the dust is most unlikely to invade or a position with a low probability of dust being distributed.

For example, since the outer portion of the vibration generating shaft (the portion penetrating through the casing and projecting outward) is covered with a belt cover in a state in which the pulley for the V belt is secured, it is possible to curb invasion of dust from the breather to the inside of the casing in a case in which the outer opening portion of the breather is formed at the outer portion of the vibration generating shaft (more specifically, in a case in which the air passage constituting the breather is formed inside the vibration generating shaft, with one end of the passage being opened in the outer portion projecting to the outside of the casing and the other end being opened inside the casing).

Patent Document 1: JP 56-13369 Y2

SUMMARY OF INVENTION

Technical Problem

However, in a case in which the air passage constituting the breather is formed inside the vibration generating shaft and the outer opening portion of the breather is formed at the outer portion of the vibration generating shaft, there is a problem that, in a case in which the vibrating compaction machine is partially (a lower half portion, for example) submerged, water easily invades the inside of the casing of the vibration generating device.

In the typical vibrating compaction machine, the vibration generating device is secured to an upper surface of the compacting plate such that generated vibration can be effectively transmitted to the compacting plate located at the lowermost portion, and the motor is secured over a support base held above the compacting plate via vibration damping means at a higher position than the vibration generating device. In other words, in a case in which the vibrating compaction machine is stored outdoors, such as at a work site, in an unmanned state and flooding occurs in the vicinity thereof due to heavy rain, sudden torrential rain, or the like, the compacting plate is submerged first, and then the vibration generating device and the motor are submerged in that order with elevation of the water level.

Here, although it is obvious that the entire vibrating compaction machine has to be repaired in a case in which the motor and parts below the motor have been submerged, there is a possibility that in a case in which the motor has not been submerged and only the lower half parts (the vibration generating device and parts below the vibration generating device) have been submerged, it is not possible for an administrator to recognize that the lower half part has been submerged since the motor itself operates without any problems. If the vibration generating device with the breather formed at the vibration generating shaft is submerged, then water invades the inside of the casing via the breather, and if the motor is activated in this state to cause the vibration generating device to operate, there is a high possibility that malfunction or damage of the machine will occur due to an increase in a rotational load, rusting of the bearings, or the like.

The present invention is intended to solve such problems in the prior art, and an object thereof is to provide a breather for a vibration generating device capable of allowing air to flow in or out in accordance with a pressure difference between the inside and outside of a casing when the vibration generating device is operating and capable of inhibiting invasion of water into the casing even in a case of submersion at a non-operating time.

Solution to Problem

A breather for a vibration generating device according to the present invention is formed at a vibration generating shaft configured of an inner portion extending inside a casing of the vibration generating device and an outer portion penetrating through the casing and projecting outward, the breather is characterized by including: a center passage formed inside the vibration generating shaft to extend from the inner portion to the outer portion of the vibration generating shaft; an inner opening portion formed in an outer circumferential surface of the inner portion of the vibration generating shaft; an intake opening portion formed in a surface of the outer portion of the vibration generating shaft; an exhaust opening portion formed in a surface of the outer portion of the vibration generating shaft; an inner passage causing the center passage and the inner opening portion to communicate with each other; an intake passage causing the center passage and the intake opening portion to communicate with each other; and an exhaust passage causing the center passage and the exhaust opening portion to communicate with each other, wherein an intake valve configured of a valve body, a valve seat disposed further outward in a radial direction than the valve body, and a spring biasing the valve body from a side of the center passage toward a side of the intake opening portion and configured to open in a case in which a pressure in the casing becomes a negative pressure, is disposed inside the intake passage, and an exhaust valve configured of a valve body, a valve seat disposed further inward in the radial direction than the valve body, and a spring biasing the valve body from a side of the exhaust opening portion toward the side of the center passage and configured to open in a case in which a pressure in the casing becomes a positive pressure, is disposed inside the exhaust passage.

Note that, when the vibration generating shaft is in a non-rotating state, the breather for a vibration generating device is preferably configured such that the intake valve opens to allow air to flow into the casing in a case where a pressure in the casing becomes a negative pressure and a pressure difference between inside and outside of the casing exceeds a specific value, and the breather is preferably configured such that the exhaust valve opens to allow air to flow out of the casing in a case where a pressure in the casing becomes a positive pressure and a pressure difference between inside and outside of the casing exceeds a specific value.

Also, when the vibration generating shaft is in a rotating state, the breather is preferably configured such that a valve opening pressure of the intake valve becomes higher than when the vibration generating shaft is in a non-rotating state, and the breather is preferably configured such that a valve opening pressure of the exhaust valve becomes lower than when the vibration generating shaft is in a non-rotating state or the exhaust valve opens.

Moreover, the center passage is preferably formed along a central axis line of the vibration generating shaft, and further, the intake opening portion is preferably formed in an outer circumferential surface of the outer portion of the vibration generating shaft, and the exhaust opening portion is preferably formed at a distal end portion of the outer portion of the vibration generating shaft.

Further, a breather for a vibration generating device according to the present invention is formed at a vibration generating shaft configured of an inner portion extending inside a casing of the vibration generating device and an outer portion penetrating through the casing and projecting outward, and at a member secured to the outer portion, the breather including a center passage formed inside the vibration generating shaft to extend from the inner portion to the outer portion of the vibration generating shaft; an inner opening portion formed in an outer circumferential surface of the inner portion of the vibration generating shaft; an intake opening portion formed in a surface of the member secured to the outer portion of the vibration generating shaft; an exhaust opening portion formed in a surface of the member secured to the outer portion of the vibration generating shaft; an inner passage causing the center passage and the inner opening portion to communicate with each other; an intake passage causing the center passage and the intake opening portion to communicate with each other; and an exhaust passage causing the center passage and the exhaust opening portion to communicate with each other, wherein an intake valve configured of a valve body, a valve seat disposed further outward in a radial direction than the valve body, and a spring biasing the valve body from a side of the center passage toward a side of the intake opening portion and configured to open in a case in which a pressure in the casing becomes a negative pressure, is disposed inside the intake passage, and an exhaust valve configured of a valve body, a valve seat disposed further inward in the radial direction than the valve body, and a spring biasing the valve body from a side of the exhaust opening portion toward the side of the center passage and configured to open in a case in which a pressure in the casing becomes a positive pressure, is disposed inside the exhaust passage.

Advantageous Effects of Invention

A vibration generating device to which the breather for a vibration generating device according to the present invention is applied can suitably avoid problems such as damage of the oil seal that seals the vibration generating shaft. Also, the breather for a vibration generating device according to the present invention can suitably curb invasion of dust from the breather into a casing since the intake opening portion and the exhaust opening portion are formed at the outer portion of the vibration generating shaft and this outer portion is covered with a belt cover.

Moreover, the vibration generating device to which the breather for a vibration generating device according to the present invention is applied can avoid a problem that a lubricant oil inside the casing leaks out of the breather regardless of a direction in which a posture of a vibrating compaction machine with the vibration generating device mounted thereon is caused to change, since the intake valve and the exhaust valve are maintained in a closed state unless a pressure difference between the inside and outside of the casing exceeds the prescribed value.

Also, even in a case where the vibrating compaction machine with the vibration generating device to which the breather for a vibration generating device according to the present invention is applied mounted thereon is submerged, it is possible to inhibit invasion of water into the casing with the intake valve and the exhaust valve in the closed state and to suitably avoid problems such as occurrence of malfunction or damage of the vibration generating device due to invasion of water.

DESCRIPTION OF EMBODIMENTS

Figure 1:
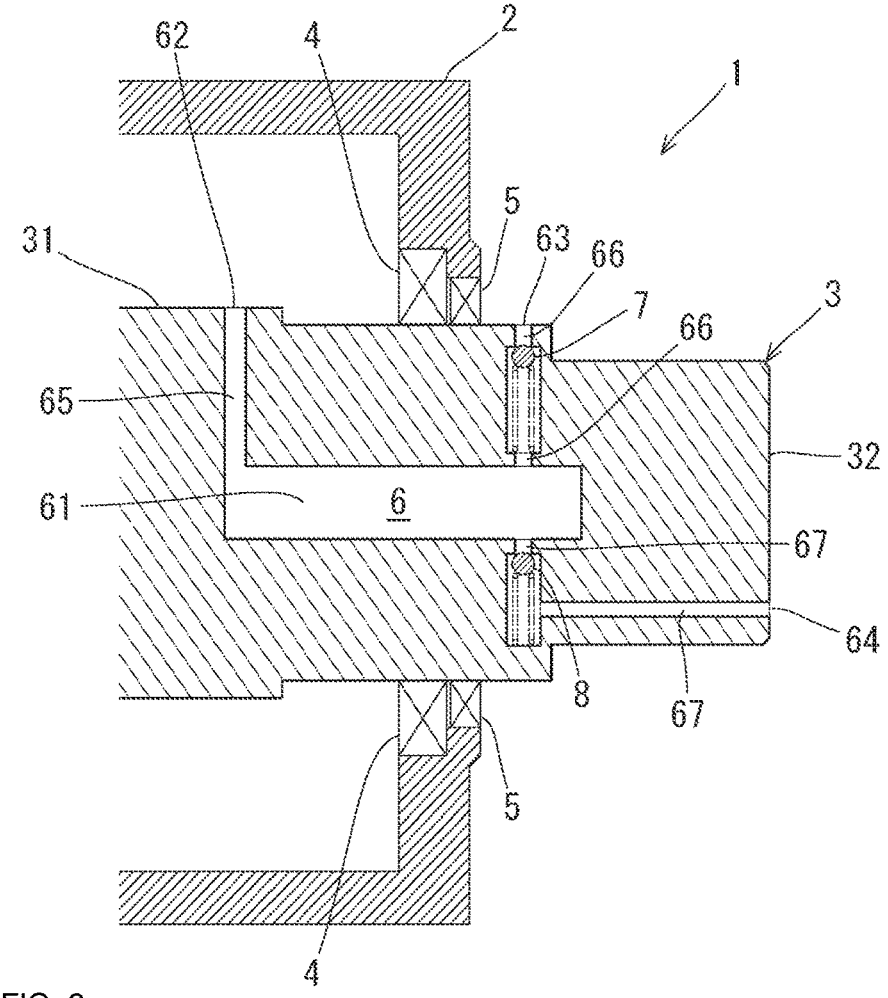
FIG. 1 is a partial sectional view of a vibration generating device 1 to which a breather 6 according to a first embodiment of the present invention is applied.

Hereinafter, embodiments of a "breather for a vibration generating device" according to the present invention will be described in accordance with the accompanying drawings. FIG. 1 is a sectional view of a vibration generating device 1 to which a breather according to a first embodiment of the present invention is applied. The vibration generating device 1 is configured of a casing 2, a vibration generating shaft 3 (rotation shaft), a bearing 4 rotatably supporting the vibration generating shaft 3, and an eccentric weight (not illustrated) attached to the vibration generating shaft 3.

The vibration generating shaft 3 is configured of an inner portion 31 extending inside the casing 2 and an outer portion 32 penetrating through the casing 2 and projecting outward. A pulley (not illustrated) is secured to the outer portion 32, and a rotational drive force is transmitted from a motor (an internal combustion engine, an electric motor, or the like) to the vibration generating shaft 3 via a V belt (not illustrated). Oil for lubricating the bearing 4 and the like is stored inside the casing 2. Also, the vibration generating shaft 3 penetrating through the casing 2 is sealed with oil seal 5 such that leakage of the lubricant oil can be prevented.

The breather 6 according to the present invention is formed at the vibration generating shaft 3 as illustrated in FIG. 1. More specifically, a center passage 61 constituting the breather 6 is formed inside the vibration generating shaft 3 to extend along a central axis line of the vibration generating shaft 3 from the side of the inner portion 31 to the side of the outer portion 32. Also, an inner opening portion 62 is formed in an outer circumferential surface of the inner portion 31 of the vibration generating shaft 3, and two outer opening portions (an intake opening portion 63 and an exhaust opening portion 64) are formed in surfaces of the outer portion 32. Note that the intake opening portion 63 is formed in an outer circumferential surface of the outer portion 32 while the exhaust opening portion 64 is formed at a distal end portion of the outer portion 32.

The inner opening portion 62 communicates with the center passage 61 via an inner passage 65, and the intake opening portion 63 communicates with the center passage 61 via an intake passage 66. Also, the exhaust opening portion 64 communicates with the center passage 61 via an exhaust passage 67.

Figure 2:
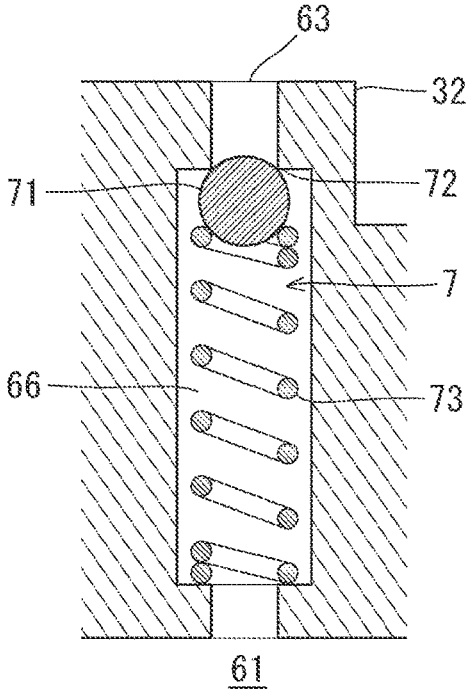
FIG. 2 is an enlarged sectional view of an intake valve 7 illustrated in FIG. 1.

An intake valve 7 is disposed inside the intake passage 66. The intake valve 7 is configured of a ball valve 71 (valve body), a valve seat 72, and a spring 73 biasing the ball valve 71 toward the valve seat 72 as illustrated in FIG. 2.

Inside the intake passage 66, the ball valve 71 is disposed further inward in the radial direction than the valve seat 72, which is on the side of the center passage 61, and the valve seat 72 is disposed further outward in the radial direction than the ball valve 71, which is on the side of the intake opening portion 63. Therefore, the intake valve 7 is configured to be closed with the ball valve 71 pressed by the spring 73 from the side of the center passage 61 toward the side of the intake opening portion 63.

The intake valve 7 opens in a case in which a pressure in the casing 2 becomes a negative pressure and a pressure acting on the ball valve 71 due to a pressure difference between the inside and the outside of the casing 2 exceeds a set valve opening pressure, and outside air flows from the intake opening portion 63 to the inside of the casing 2 through the intake passage 66, the center passage 61, and the inner passage 65.

The valve opening pressure of the intake valve 7 when the vibration generating shaft 3 is in a non-rotating state can be calculated from a pressure receiving area of the ball valve 71, a spring constant of the spring 73, and the like. Also, it is possible to realize a desired valve opening pressure through appropriate adjustment of these values.

On the other hand, when the vibration generating device 1 is operating, that is, when the vibration generating shaft 3 is in a rotating state, a centrifugal force acts on the ball valve 71, and a valve opening pressure of the intake valve 7 becomes higher than when the vibration generating shaft 3 is in a non-rotating state since the ball valve 71 is located further inward in the radial direction than the valve seat 72.

Figure 3:
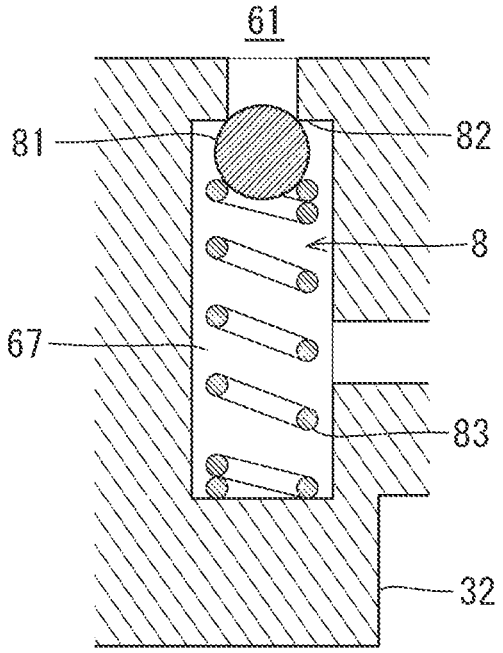
FIG. 3 is an enlarged sectional view of an exhaust valve 8 illustrated in FIG. 1.

An exhaust valve 8 is disposed inside the exhaust passage 67. The exhaust valve 8 is configured of a ball valve 81 (valve body), a valve seat 82, and a spring 83 biasing the ball valve 81 toward the valve seat 82 as illustrated in FIG. 3.

Inside the exhaust passage 67, the ball valve 81 is disposed further outward in the radial direction than the valve seat 82, which is on the side of the exhaust opening portion 64 (see FIG. 1), and the valve seat 82 is disposed further inward in the radial direction than the ball valve 81, which is on the side of the center passage 61. Therefore, the exhaust valve 8 is configured to be closed with the ball valve 81 pressed by the spring 83 from the side of the exhaust opening portion 64 (see FIG. 1) toward the side of the center passage 61.

The exhaust valve 8 opens in a case in which a pressure in the casing 2 becomes a positive pressure and a pressure acting on the ball valve 81 due to a pressure difference between the inside and the outside of the casing 2 exceeds the set valve opening pressure, and air inside the casing 2 flows out from the exhaust opening portion 64 to the outside of the casing 2 through the inner passage 65, the center passage 61, and the exhaust passage 67.

The valve opening pressure of the exhaust valve 8 when the vibration generating shaft 3 is in a non-rotating state can be calculated from a pressure receiving area of the ball valve 81, a spring constant of the spring 83, and the like. Also, it is possible to realize a desired valve opening pressure through appropriate adjustment of these values.

On the other hand, when the vibration generating shaft 3 is in a rotating state, a centrifugal force acts on the ball valve 81, and a valve opening pressure of the exhaust valve 8 becomes lower than when the vibration generating shaft 3 is in a non-rotating state, or the exhaust valve 8 opens, since the ball valve 81 is located further outward in the radial direction than the valve seat 82.

As described above, the vibration generating device 1 illustrated in FIG. 1 is configured such that, in a case in which a pressure difference occurs between the inside and the outside of the casing 2 and the magnitude of the pressure difference exceeds the prescribed value, the intake valve 7 or the exhaust valve 8 of the breather 6 opens to distribute air, and it is thus possible to suitably avoid the problems such as damage of the oil seal that seals the vibration generating shaft 3. Also, the breather 6 includes the outer opening portions (the intake opening portion 63 and the exhaust opening portion 64) formed at the outer portion 32 of the vibration generating shaft 3, the outer portion 32 is covered with the belt cover, and it is thus possible to suitably curb invasion of dust from the breather 6 to the inside of the casing 2.

Further, the vibration generating device 1 illustrated in FIG. 1 can avoid the problem that the lubricant oil in the casing 2 leaks out of the breather 6 regardless of a direction in which the posture of the vibrating compaction machine with the vibration generating device 1 mounted thereon is changed, for example, even in a case in which the machine body is inclined in such a direction that the breather 6 is located on the lower side, since the intake valve 7 and the exhaust valve 8 of the breather 6 are maintained in a closed state unless the pressure difference between the inside and the outside of the casing 2 exceeds the prescribed value.

Also, even in a case in which the vibrating compaction machine with the vibration generating device 1 in FIG. 1 mounted thereon is submerged, it is possible to inhibit invasion of water into the casing 2 with the intake valve 7 and the exhaust valve 8 in a closed state and to suitably avoid the problems such as occurrence of malfunction or damage of the vibration generating device 1 due to invasion of water. When the vibration generating device 1 is not operating, invasion of water does not occur even in a case where submersion occurs in a state in which the pressure inside the casing 2 has dropped to such an extent that the intake valve 7 opens. This is because, among fluids, water is less likely to pass through the valves than air, and it is possible to prevent invasion of wataer unless the temperature inside the casing 2 changes significantly steeply and drastically, for example, except for a case where the vibrating compaction machine is submerged in a state in which a temperature rise is saturated after the vibration generating device 1 is operated for a long period of time.

Note that, although the present embodiment employs a configuration in which the intake passage 66 with the intake valve 7 disposed therein and a part of the exhaust passage 67 with the exhaust valve 8 disposed therein are arranged in series in the radial direction of the vibration generating shaft 3 (that is, a configuration in which the intake passage 66 and the part of the exhaust passage 67 are disposed at positions of 180° with the central axis line of the vibration generating shaft 3 interposed therebetween) as illustrated in FIG. 1, the portion of the exhaust passage 67 at which the exhaust valve 8 is disposed can also be formed at a position deviating in a turning direction or the central axis line direction of the vibration generating shaft 3 (for example, a position moved 90° around the central axis line of the vibration generating shaft 3 or a position moved on the side of the exhaust opening portion 64). In this case, a connection hole for introducing the ball valve 71, the spring 73, and the like of the intake valve 7 into the intake passage 66 at the time of assembly can be formed at a position where the exhaust valve 8 is disposed in FIG. 1.

Also, although the intake opening portion 63 and the exhaust opening portion 64 constituting the breather 6 are formed in the surface of the outer portion 32 of the vibration generating shaft 3 as illustrated in FIG. 1 in the aforementioned embodiment, it is also possible to form each of the intake opening portion and the exhaust opening portion in a surface of a "member secured to the outer portion" (a member that is secured to the outer portion 32 and rotates integrally with the outer portion 32, such as a pulley or a collar (not illustrated), for example), to form the intake passage that causes the center passage 61 and the intake opening portion to communicate with each other and to form the exhaust passage that causes the center passage 61 and the exhaust opening portion to communicate with each other inside the "member secured to the outer portion" and inside the outer portion 32, to dispose the intake valve inside the intake passage (inside the "member secured to the outer portion" and/or inside the outer portion 32), and to dispose the exhaust valve inside the exhaust passage (inside the "member secured to the outer portion" and/or inside the outer portion 32).

REFERENCE SIGNS LIST

1 Vibration generating device
2 Casing
3 Vibration generating shaft
31 Inner portion
32 Outer portion
4 Bearing
5 Oil seal
6 Breather
61 Center passage
62 Inner opening portion
63 Intake opening portion
64 Exhaust opening portion
65 Inner passage
66 Intake passage
67 Exhaust passage
7 Intake valve
71 Ball valve
72 Valve seat
73 Spring
8 Exhaust valve
81 Ball valve
82 Valve seat
83 Spring

The invention claimed is:

1. A breather for a vibration generating device formed at a vibration generating shaft configured of an inner portion extending inside a casing of the vibration generating device and an outer portion penetrating through the casing and projecting outward, the breather comprising:

a center passage formed inside the vibration generating shaft to extend from the inner portion to the outer portion of the vibration generating shaft;

an inner opening portion formed in an outer circumferential surface of the inner portion of the vibration generating shaft;

an intake opening portion formed in a surface of the outer portion of the vibration generating shaft;

an exhaust opening portion formed in a surface of the outer portion of the vibration generating shaft;

an inner passage causing the center passage and the inner opening portion to communicate with each other;

an intake passage causing the center passage and the intake opening portion to communicate with each other; and an exhaust passage causing the center passage and the exhaust opening portion to communicate with each other, wherein an intake valve configured of a valve body, a valve seat disposed further outward in a radial direction than the valve body, and a spring biasing the valve body from a side of the center passage toward a side of the intake opening portion and configured to open in a case in which a pressure in the casing becomes a negative pressure, is disposed inside the intake passage, and an exhaust valve configured of a valve body, a valve seat disposed further inward in the radial direction than the valve body, and a spring biasing the valve body from a side of the exhaust opening portion toward the side of the center passage and configured to open in a case in which a pressure in the casing becomes a positive pressure, is disposed inside the exhaust passage.

2. The breather for a vibration generating device according to claim 1, wherein the breather is configured such that when the vibration generating shaft is in a non-rotating state, the intake valve opens to allow air to flow into the casing in a case where a pressure in the casing becomes a negative pressure and a pressure difference between the inside and outside of the casing exceeds a specific value.

3. The breather for a vibration generating device according to claim 1, wherein the breather is configured such that when the vibration generating shaft is in a non-rotating state, the exhaust valve opens to allow air to flow out of the casing in a case where a pressure in the casing becomes a positive pressure and a pressure difference between the inside and outside of the casing exceeds a specific value.

4. The breather for a vibration generating device according to claim 1, wherein the breather is configured such that when the vibration generating shaft is in a rotating state, a valve opening pressure of the intake valve becomes higher than when the vibration generating shaft is in a non-rotating state.

5. The breather for a vibration generating device according to claim 1, wherein the breather is configured such that when the vibration generating shaft is in a rotating state, a valve opening pressure of the exhaust valve becomes lower than when the vibration generating shaft is in a non-rotating state or the exhaust valve opens.

6. The breather for a vibration generating device according to claim 1, wherein the center passage is formed along a central axis line of the vibration generating shaft.

7. The breather for a vibration generating device according to claim 1, wherein the intake opening portion is formed in an outer circumferential surface of the outer portion of the vibration generating shaft.

8. The breather for a vibration generating device according to claim 1, wherein the exhaust opening portion is formed at a distal end portion of the outer portion of the vibration generating shaft.

9. A breather for a vibration generating device formed at a vibration generating shaft configured of an inner portion extending inside a casing of the vibration generating device and an outer portion penetrating through the casing and projecting outward, and at a member secured to the outer portion, the breather comprising:

a center passage formed inside the vibration generating shaft to extend from the inner portion to the outer portion of the vibration generating shaft;

an inner opening portion formed in an outer circumferential surface of the inner portion of the vibration generating shaft;

an intake opening portion formed in a surface of the member secured to the outer portion of the vibration generating shaft;

an exhaust opening portion formed in a surface of the member secured to the outer portion of the vibration generating shaft;

an inner passage causing the center passage and the inner opening portion to communicate with each other;

an intake passage causing the center passage and the intake opening portion to communicate with each other; and an exhaust passage causing the center passage and the exhaust opening portion to communicate with each other, wherein an intake valve configured of a valve body, a valve seat disposed further outward in a radial direction than the valve body, and a spring biasing the valve body from a side of the center passage toward a side of the intake opening portion and configured to open in a case in which a pressure in the casing becomes a negative pressure, is disposed inside the intake passage, and an exhaust valve configured of a valve body, a valve seat disposed further inward in the radial direction than the valve body, and a spring biasing the valve body from a side of the exhaust opening portion toward the side of the center passage and configured to open in a case in which a pressure in the casing becomes a positive pressure, is disposed inside the exhaust passage.

* * * * *